US009759515B2

(12) United States Patent
Yeates

(10) Patent No.: US 9,759,515 B2
(45) Date of Patent: Sep. 12, 2017

(54) HOLSTER

(71) Applicant: Vista Outdoor Operations LLC, Clearfield, UT (US)

(72) Inventor: Eric M. Yeates, Virginia Beach, VA (US)

(73) Assignee: Vista Outdoor Operations LLC, Farmington, UT (US)

( * ) Notice: Subject to any disclaimer, the term of this patent is extended or adjusted under 35 U.S.C. 154(b) by 0 days.

(21) Appl. No.: 14/827,959

(22) Filed: Aug. 17, 2015

(65) Prior Publication Data

US 2016/0069639 A1 Mar. 10, 2016

Related U.S. Application Data

(63) Continuation of application No. 13/911,710, filed on Jun. 6, 2013, now Pat. No. 9,134,093.

(60) Provisional application No. 61/684,615, filed on Aug. 17, 2012.

(51) Int. Cl.
*F41C 33/02* (2006.01)

(52) U.S. Cl.
CPC ..... *F41C 33/0227* (2013.01); *F41C 33/0263* (2013.01); *F41C 33/0272* (2013.01); *Y10S 224/912* (2013.01); *Y10T 29/49863* (2015.01)

(58) Field of Classification Search
CPC .. F41C 33/02; F41C 33/0209; F41C 33/0218; F41C 33/0227; F41C 33/0254; F41C 33/0263; F41C 33/0272; F41C 33/041; F41C 33/043; F41C 33/045; F41C 33/046; F41C 33/048; Y10S 224/912
USPC ..... 224/192–193, 198, 238, 243–244, 224/911–912
See application file for complete search history.

(56) References Cited

U.S. PATENT DOCUMENTS

| | | | |
|---|---|---|---|
| 1,046,912 | A | 12/1912 | Wanee |
| 1,113,530 | A | 10/1914 | Audley |
| 1,148,935 | A | 2/1915 | Snavely |
| 1,421,578 | A | 7/1922 | Schussler |
| 1,641,439 | A | 8/1925 | Jovino |

(Continued)

FOREIGN PATENT DOCUMENTS

| | | | |
|---|---|---|---|
| EP | 2757271 | A2 | 7/2014 |
| WO | WO 2010/064268 | A1 | 6/2010 |

(Continued)

*Primary Examiner* — Nathan J Newhouse
*Assistant Examiner* — Scott McNurlen
(74) *Attorney, Agent, or Firm* — Christensen, Fonder, Dardi & Herbert PLLC

(57) ABSTRACT

A holster for a handgun that comprises a holster body with a handgun cavity for receiving and retaining the handgun by way of a obstructing member at the ejection port and at the rear portion of the handgun slide. Moreover, a single obscured push button actuates both mechanisms. An internal retention sleeve having an inverted U-shape is slidingly mounted within the holster body and movable between a first securement position and a second release position. The sleeve having an integral thumb button depressible downwardly whereby the sleeve moves downwardly within the body to release a ejection port stop catch and the latch hood. The sleeve biased toward a normal retention position, the handgun withdrawal obstructing member biased toward the normal retention position, the latch hood biased toward a release position but having a normal latched obstructing position until released by the sleeve.

19 Claims, 13 Drawing Sheets

(56) References Cited

U.S. PATENT DOCUMENTS

| | | | |
|---|---|---|---|
| 1,635,984 | A | 7/1927 | Corriston |
| 1,750,139 | A | 2/1928 | Swift |
| 1,851,352 | A | 3/1932 | Denkert |
| 1,951,865 | A | 3/1934 | Franz |
| 2,051,844 | A | 8/1936 | Green |
| 2,088,811 | A | 8/1937 | Ray |
| 2,109,734 | A | 3/1938 | Preneta |
| 2,349,376 | A | 5/1944 | Ray |
| 2,443,397 | A | 6/1948 | Meyres |
| 2,551,913 | A | 5/1951 | Toby |
| 2,577,869 | A | 12/1951 | Adams |
| 2,893,615 | A | 7/1959 | Couper |
| 3,289,903 | A | 12/1966 | Taormina |
| 3,419,728 | A | 12/1968 | Wilson |
| 3,420,420 | A | 1/1969 | Clark |
| 3,550,821 | A | 12/1970 | Daigle |
| 3,550,822 | A | 12/1970 | Lloyd |
| 3,669,325 | A | 6/1972 | Furman |
| 3,718,240 | A | 2/1973 | Rose |
| 3,777,952 | A | 12/1973 | Theodore |
| 3,804,306 | A | 4/1974 | Azurin |
| 3,828,990 | A | 8/1974 | Baldocchi |
| 3,866,811 | A | 2/1975 | Hamby |
| 3,904,091 | A | 9/1975 | Jones |
| 3,910,469 | A | 10/1975 | Baldocchi |
| RE30,139 | E | 11/1979 | Jones |
| 4,277,007 | A | 7/1981 | Bianchi et al. |
| 4,846,384 | A | 7/1989 | Perry |
| 5,018,654 | A | 5/1991 | Rogers et al. |
| 5,048,735 | A | 9/1991 | McCormick |
| 5,082,318 | A | 1/1992 | Held et al. |
| 5,094,376 | A | 3/1992 | Baruch |
| 5,100,036 | A | 3/1992 | Rogers et al. |
| 5,127,566 | A | 7/1992 | Beletsky |
| 5,129,562 | A | 7/1992 | Bianchi |
| 5,199,620 | A | 4/1993 | Beletsky |
| 5,215,238 | A | 6/1993 | Baruch |
| 5,275,317 | A | 1/1994 | Rogers et al. |
| 5,284,281 | A | 2/1994 | Nichols |
| 5,322,200 | A | 6/1994 | Blanchard |
| 5,358,160 | A | 10/1994 | Bianchi |
| 5,372,288 | A | 12/1994 | Rogers et al. |
| 5,395,021 | A | 3/1995 | Brown |
| 5,419,474 | A | 5/1995 | Marx et al. |
| 5,421,497 | A | 6/1995 | Gilmore |
| 5,449,103 | A | 9/1995 | Tilley |
| 5,458,266 | A | 10/1995 | Pichot |
| 5,467,909 | A | 11/1995 | Resca et al. |
| 5,501,380 | A | 3/1996 | Wu |
| 5,501,381 | A | 3/1996 | Rogers et al. |
| 5,509,591 | A | 4/1996 | Carver |
| 5,513,785 | A | 5/1996 | Campagna, Jr. |
| 5,518,155 | A | 5/1996 | Gallagher |
| 5,551,611 | A | 9/1996 | Gilmore |
| 5,570,830 | A | 11/1996 | Nichols |
| 5,573,157 | A | 11/1996 | Mauriello et al. |
| 5,598,958 | A | 2/1997 | Ryan, III et al. |
| 5,611,164 | A | 3/1997 | Rassias |
| 5,749,507 | A | 5/1998 | Wood |
| 5,758,448 | A | 6/1998 | Thummel |
| 5,768,816 | A | 6/1998 | Rassias |
| 5,779,114 | A | 7/1998 | Owens |
| 5,806,739 | A | 9/1998 | Wood |
| 5,810,221 | A | 9/1998 | Beletsky et al. |
| 5,810,222 | A | 9/1998 | Shoemaker |
| 5,855,305 | A | 1/1999 | Nichols |
| 5,916,087 | A | 6/1999 | Owens |
| 5,918,784 | A | 7/1999 | Serpa |
| 5,927,578 | A | 7/1999 | Kay |
| 5,944,239 | A | 8/1999 | Rogers et al. |
| 5,961,013 | A | 10/1999 | Collins |
| 6,085,951 | A | 7/2000 | Beletsky et al. |
| 6,112,962 | A | 9/2000 | Matthews |
| 6,149,042 | A | 11/2000 | Rassias |
| 6,189,751 | B1 | 2/2001 | Tserng |
| 6,230,946 | B1 | 5/2001 | Vor Keller et al. |
| 6,267,279 | B1 | 7/2001 | Matthews |
| 6,276,581 | B1 | 8/2001 | Glock |
| 6,320,975 | B1 | 11/2001 | Vieweg |
| 6,349,496 | B1 | 2/2002 | Neely |
| 6,389,726 | B1 | 5/2002 | Bentley |
| 6,415,541 | B1 | 7/2002 | Rassias |
| 6,467,660 | B1 | 10/2002 | Rogers et al. |
| 6,523,374 | B1 | 2/2003 | Owens |
| 6,533,149 | B2 | 3/2003 | Vor Keller et al. |
| 6,547,111 | B2 | 4/2003 | French |
| 6,585,209 | B1 | 7/2003 | Mattingly |
| 6,588,635 | B2 | 7/2003 | Vor Keller et al. |
| 6,604,657 | B2 | 8/2003 | Yirmiyahu et al. |
| 6,616,020 | B1 | 9/2003 | Spielberger |
| 6,634,527 | B2 | 10/2003 | Lui |
| 6,641,009 | B2 | 11/2003 | French et al. |
| 6,732,891 | B2 | 5/2004 | Locklear, III |
| 6,752,300 | B2 | 6/2004 | Har-Shen |
| 6,755,331 | B2 | 6/2004 | Rassias |
| 6,769,581 | B2 | 8/2004 | Rogers et al. |
| 6,769,582 | B1 | 8/2004 | Beletsky et al. |
| 6,799,392 | B2 | 10/2004 | Milec et al. |
| 6,854,626 | B2 | 2/2005 | Liao |
| 6,886,725 | B2 | 5/2005 | Lowe et al. |
| 6,918,519 | B2 | 7/2005 | Vor Keller et al. |
| 6,948,644 | B1 | 9/2005 | Beletsky |
| 7,140,523 | B2 | 11/2006 | Lowe et al. |
| 7,200,965 | B2 | 4/2007 | Vor Keller et al. |
| 7,434,712 | B2 | 10/2008 | Cook et al. |
| 7,461,765 | B2 | 12/2008 | French et al. |
| 7,530,456 | B1 | 5/2009 | Tsai |
| 7,543,404 | B2 | 6/2009 | Kovalchuk et al. |
| 7,556,181 | B2 | 7/2009 | Spielberger |
| 7,562,797 | B2 | 7/2009 | Senn et al. |
| 7,584,875 | B2 | 9/2009 | Lowe et al. |
| 7,591,402 | B2 | 9/2009 | Rassias |
| 7,644,845 | B2 | 1/2010 | Lowe |
| 7,694,860 | B2 | 4/2010 | Clifton, Jr. |
| 7,819,294 | B2 | 10/2010 | Lowe et al. |
| 7,841,497 | B1 | 11/2010 | Gregory et al. |
| 7,850,053 | B2 | 12/2010 | Rassias |
| 7,922,050 | B2 | 4/2011 | Benes |
| 7,937,880 | B1 | 5/2011 | Fidlow |
| 7,950,553 | B2 | 5/2011 | Rassias |
| 7,954,971 | B1 | 6/2011 | Kincaid et al. |
| 8,052,018 | B2 | 11/2011 | Gallagher |
| 8,096,453 | B2 | 1/2012 | Lowe et al. |
| 8,132,355 | B1 | 3/2012 | Kincaid et al. |
| 8,141,758 | B2 | 3/2012 | Spielberger |
| 8,177,108 | B1 | 5/2012 | Kincaid et al. |
| 8,215,525 | B2 | 7/2012 | Rassias |
| 8,235,263 | B1 | 8/2012 | Yeates et al. |
| 8,281,512 | B2 | 10/2012 | Lara |
| 8,302,827 | B1 | 11/2012 | Cole |
| 8,371,487 | B1 | 2/2013 | Plappert |
| 8,474,670 | B1 | 7/2013 | Gregory et al. |
| RE44,428 | E | 8/2013 | Spielberger |
| 8,517,235 | B1 | 8/2013 | Kincaid et al. |
| 8,544,706 | B2 | 10/2013 | Crye |
| 8,602,275 | B1 | 12/2013 | Kiger et al. |
| 8,602,276 | B2 | 12/2013 | Tyybakinoja |
| 8,631,981 | B2 | 1/2014 | Zusman |
| 8,646,665 | B2 | 2/2014 | Abushaev |
| 8,690,032 | B2 | 4/2014 | Baumann et al. |
| 8,720,753 | B2 | 5/2014 | Benes |
| 8,720,754 | B2 | 5/2014 | Kirsch |
| 8,720,755 | B2 | 5/2014 | Gregory et al. |
| 8,807,404 | B1 | 8/2014 | Howell et al. |
| 8,851,344 | B2 | 10/2014 | Baumann et al. |
| 8,870,042 | B2 | 10/2014 | Clifton |
| 8,910,839 | B2 | 12/2014 | Clifton |
| 8,925,773 | B2 | 1/2015 | Clifton |
| 8,985,412 | B2 | 3/2015 | Rorick et al. |
| 9,016,533 | B2 | 4/2015 | Visalli et al. |
| 9,022,262 | B2 | 5/2015 | Pellegrini |
| 9,057,579 | B2 | 6/2015 | Rorick et al. |
| 9,057,580 | B2 | 6/2015 | Rorick et al. |
| 9,134,093 | B2 | 9/2015 | Yeates |

(56) References Cited

U.S. PATENT DOCUMENTS

| | | | |
|---|---|---|---|
| 9,175,925 | B2 | 11/2015 | Pellegrini |
| 9,228,802 | B2 | 1/2016 | Ribas |
| 2005/0205621 | A1 | 9/2005 | Shults |
| 2005/0205624 | A1 | 9/2005 | French et al. |
| 2005/0279789 | A1 | 12/2005 | Lowe |
| 2006/0156525 | A1 | 7/2006 | Jenkins et al. |
| 2006/0157520 | A1 | 7/2006 | Clifton, Jr. |
| 2006/0175366 | A1 | 8/2006 | Dekaise |
| 2006/0226185 | A1 | 10/2006 | Har-Shen |
| 2007/0181619 | A1 | 8/2007 | Seyfert et al. |
| 2008/0110947 | A1 | 5/2008 | Pikielny |
| 2008/0121670 | A1 | 5/2008 | Buress |
| 2008/0179360 | A1 | 7/2008 | Lowe et al. |
| 2009/0321480 | A1 | 12/2009 | Kincaid et al. |
| 2010/0276464 | A1 | 11/2010 | Hirt et al. |
| 2011/0011904 | A1 | 1/2011 | Schultz et al. |
| 2011/0101063 | A1 | 5/2011 | Zusman |
| 2011/0163138 | A1 | 7/2011 | Tybakinoja |
| 2011/0174850 | A1 | 7/2011 | Clifton, Jr. |
| 2013/0240582 | A1 | 9/2013 | Tyybakinoja et al. |
| 2014/0048572 | A1 | 2/2014 | Yeates |
| 2014/0109345 | A1 | 4/2014 | Melville |

FOREIGN PATENT DOCUMENTS

| | | | |
|---|---|---|---|
| WO | WO 2013/071402 | A1 | 5/2013 |
| WO | WO 2014/028876 | A1 | 2/2014 |
| ZA | 986778 | | 2/1999 |

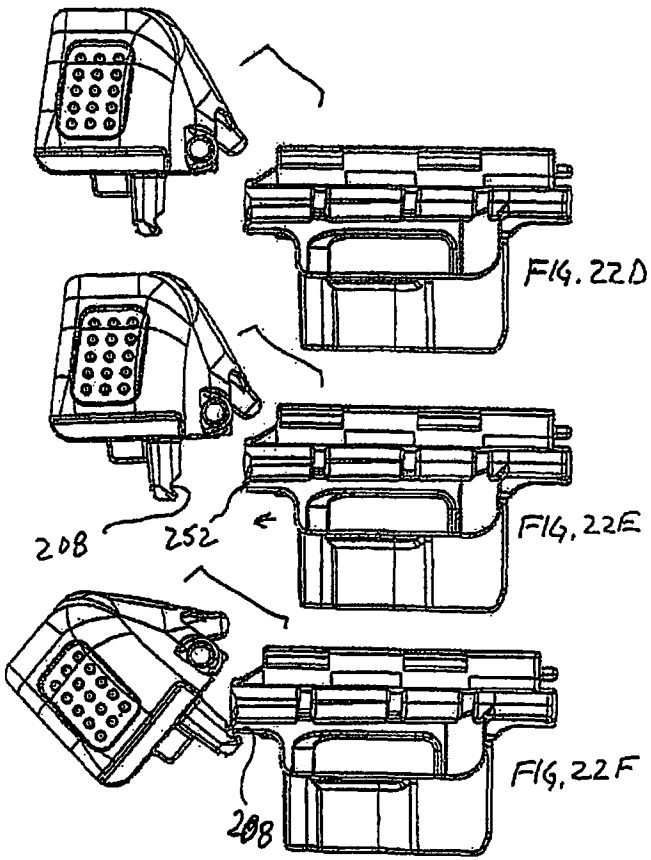
FIG. 22D
FIG. 22E
FIG. 22F
252
208
208
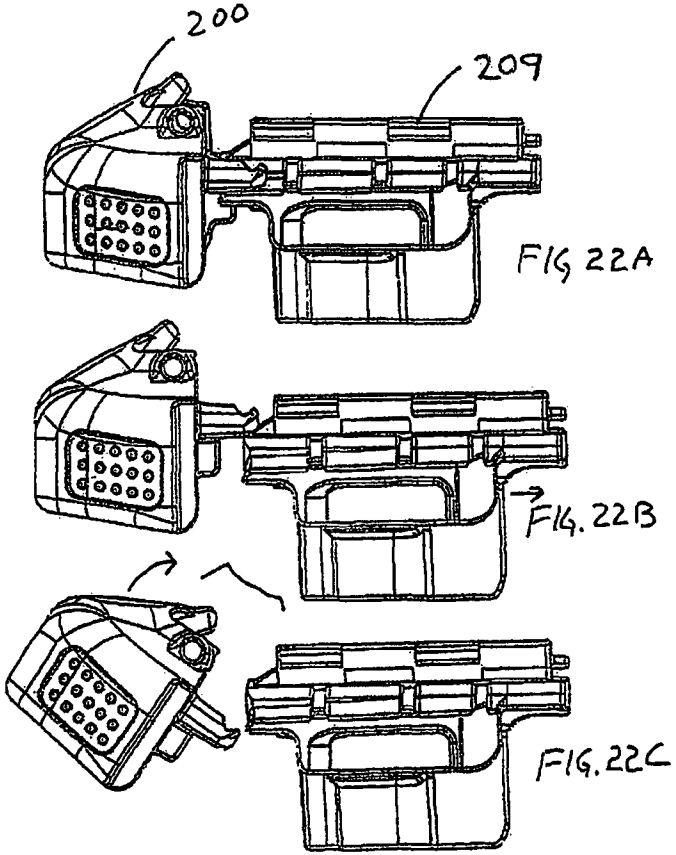
FIG 22A
FIG. 22B
FIG. 22C
209
200

HOLSTER

CROSS-REFERENCE TO RELATED APPLICATIONS

The present application is a continuation of U.S. patent application Ser. No. 13/911,710, filed Jun. 6, 2013, which claims the benefit of U.S. Provisional Patent Application No. 61/684,615, filed Aug. 17, 2012, both of which are hereby incorporated by reference herein in their entireties.

BACKGROUND OF THE INVENTION

Current rigid polymer holsters that utilize retention mechanisms for preventing removal of the handgun typically secure the handgun at the trigger guard Holsters that utilize trigger guard latch mechanisms generally cannot accommodate accessories mounted forwardly of the trigger guard of the handgun, such as laser sights. Moreover, a particular holster design for different handguns, or for the same handgun with accessories, will typically require entirely new component configurations for a particular model of holster. This is due to the requirement for proper operation of the release mechanism of a very close form fit between the handgun and the holster. Such requires different mold sets for each configuration greatly increasing manufacturing cost. Additionally when a holster has more than one retention feature, often mechanisms are either complicated, not reliable, and/or the actuation buttons are readily visible. It would be advantageous to have less visible release buttons on a holster, capability of capturing handguns with accessories forward of the trigger guard. Also, the capability for utilizing common components in holsters for different handguns would be beneficial in a cost perspective.

SUMMARY

Accordingly, embodiments of the present invention address the above with a holster for a handgun that comprises a holster body with a defined handgun cavity for receiving and retaining the handgun at the ejection port and at the rear end of the handgun slide. Moreover, a single obscured push button actuates both mechanisms. The holster comprising a holster body having an upper opening for inserting and removing the handgun, a cavity for receiving the handgun and having a bottom or lower wall portion and a first and an opposite second side wall, a forward wall and a rearward wall portion. A pivot guard or latch hood configured is pivotally connected between the first and second walls adjacent to the forward wall portion and at the upper opening, the latch hood having a capture position extending over the handgun slide end and a release open position with a spring bias towards the release open position. An internal retention sleeve having an inverted U-shape is slidingly mounted within the holster body at the forward wall portion and extending downwardly to the first and second side walls. The U-shaped sleeve movable between a first securement position and a second release position. The U-shaped sleeve sized to receive and move along an upper portion of the handgun, primarily the slide. The sleeve having an integral thumb button depressible downwardly whereby the sleeve moves downwardly within the body. A resilient cantilevered leaf spring has an ejection port stop catch, an actuation portion and an end secured to the body. The stop catch being in an obstructing position with the ejection port in a first normal position and movable to a second release position. The actuation portion engageable with an engagement portion of the sleeve, at least one of the intermediate portion and sleeve having a cam wedge portion whereby when the sleeve is moved downwardly, the leaf spring is deflected out of the obstructing position with the ejection port.

The sleeve further having a latch hood engagement portion and the latch hood further having a sleeve engagement portion that cooperate with each other, whereby the latch hood engagement portion and the sleeve engagement portion are latchable together when the latch hood is in the capture position for retaining the latch hood in said capture position, and wherein sliding the U-shaped slide portion forwardly toward the second release position disengages the latch hood engagement portion and the sleeve portion engagement portion allowing the latch hood to open to the release position driven by the bias of the latch hood toward the release position.

After the handgun is removed, the latch hood remains open. Resetting the retention mechanisms is accomplished by replacing the gun in the holster, slightly depressing the push button and rotating the latch hood to the capture position and then releasing the push button such that the cooperating engagement portions of the sleeve and the latch hood are engaged.

A feature and advantage of embodiments of the invention is the retention sleeve that is removable from the holster body. The removable retention sleeve can have various shapes and sizes for different handguns so that a particular retention sleeve can fit into the holster body and then be switched out with another retention sleeve, depending on the desired type of handgun for use. Thus, manufacturing costs for holsters for different handguns can be reduced. In embodiments, the end consumer may be able to switch out the sleeves.

In particular embodiments, the latch hood is in a closed position when the latch hood is engaged with the retention sleeve. To engage the retention sleeve with the latch hood, the retention sleeve may have at least one or more projections or prongs that slide into or fit into compartments, sleeves, or pockets of the latch hood. Alternatively, the latch hood may have one or more projections or prongs that fit into or slide into compartments, sleeves, or pockets of the retention sleeve.

Embodiments of the invention include the individual mechanisms as well. A feature and advantage of embodiments is a latch hood operated by a push button attached to an axially movable member that slide or moves out of a latching engagement with the latch hood and the latch hood by way of a spring bias rotates to the open position allowing removal of the handgun.

The retention sleeve may include at least one projecting that extends out on one end of the retention sleeve. In one embodiment, the projecting component extends towards the front of the gun, downwardly in the holster body, and is sized to capture a spring. The spring engages a spring catch of the interior of the holster body to provide a bias of the sleeve towards the open top of the holster. A feature and advantage of the holster is that the pivoting latch hood can remain open when the handgun is reholstered to provide a lesser retention level than with the latch hood in a capture position.

A feature and advantage of embodiments is the release lever coupled to the retention sleeve. When the release sleeve and latch hood are engaging with each other, pressing downward (or forward) on the release lever simultaneously or sequentially actuates and disengages the catch wedge of the latch member from the ejection port of a handgun and disengages the prongs from the latch hood from the compartments, pockets, or sleeves of the retention sleeve. A spring or other resilient material may be placed underneath ejection port capture member for primary or supplemental bias in the obstruction position with the ejection port.

A feature and advantage of embodiments of the invention is that the retention of the firearm at the slide allows the holster to be configured to receive firearms with laser illumination sights units mounted forwardly of the trigger guard. Conventional holsters with trigger guard retention mechanisms cannot receive firearms with such laser sights.

A feature and advantage of embodiments of the invention is a single thumb actuated push button that releases the spring loaded pivoting latch hood h and a gun withdrawal obstruction member. In embodiments the obstruction member may be on the trigger guard, in embodiments on the ejection port.

A feature and advantage of embodiments of the invention is that a single motion with the thumb depression can actuate the latch hood to snap open providing a provocative signal to a potential suspect that the gun may be deployed. A feature and advantage of the embodiments of the invention is that the actuation button is not readily visible. Moreover, in embodiments, the push button is positioned in a difficult to access position by others not wearing the holster. In embodiments the button is forward of the hood and intermediate the firearm and holster attachment portion, for example, a belt clip. Also, the user may mute the latch hood "snap" by preventing it from snapping open with the same hand actuating the push button.

The holster can attach to a holster holding device so that the holster can hang from a particular location, like the belt of a user. The holster holding device can attach to the outside of the holster by lining up a mounting plate located in the interior of the holster body with the holster holding device located on the exterior of the holster body. In one embodiment, the holster body, mounting plate, and holster holding device will each have a set or series of sets of holes that can be lined up and then fastened together, i.e. a screw.

These and other features and aspects of the present invention may be described below in connection with some exemplary embodiments of the invention and other attributes and benefits of the foregoing will be apparent to one of ordinary skill in the art from the following drawings and detailed description. Other holsters which disclose mechanisms and configurations that are suitable for portions of embodiments of the invention of this application are illustrated in U.S. Patent/Publication Nos. US 2007/0181619, US 2011/0163138, U.S. Pat. Nos. 7,694,860 and 7,556,181, which are incorporated by reference herein.

In an embodiment of the invention, a holster shell with a insertion/withdrawal direction, a thumb pushbutton is on one side of the holster and connects to linkage that transfers a downward motion of the button on the one side to an opposite side of the holster and the linkage engages an ejection port obstruction member that has an obstructing position and a release position with respect to engagement of a handgun at the ejection port, the handgun in the holster shell, the ejection port obstruction member being movable to a release position by the downward motion. The obstruction member biased to a normal obstruction position. In embodiments, the pushbutton retains a pivoting hood, positioned above a rear portion of a slide of the handgun, in a retention position, the actuation of the pushbutton releasing the pivoting hood to a non-retention position, the hood biased, such as by a spring, to the non-retention position.

The above summary of the various representative features and aspects of the present invention is not intended to describe each illustrated embodiment or every implementation of the present invention. Rather, the various representative features and aspects are chosen and described so that others skilled in the art may appreciate and understand the principles of certain aspects of the present invention. The figures in the detailed description that follows more particularly exemplify such aspects of the present invention.

DESCRIPTION OF THE FIGURES

FIG. 22A is a side view of the latch hood in a retention position secured in place by the actuation sleeve, for purposes of clarity, the holster body is not shown.

FIG. 22B is a side view of the latch hood of FIG. 22A with the manual pushbutton of the actuation sleeve being depressed commencing the handgun release sequence.

FIG. 22C is a side view of the latch hood of FIG. 22A with the sleeve moved to the release position allowing the pivot hood to snap open.

FIG. 22D is a side view of the latch hood of FIG. 22A with the pivot hood in the release-full open position and the sleeve full forward.

FIG. 22E is a side view of the latch hood of FIG. 22A with the sleeve retracted.

FIG. 22F is a side view of the latch hood of FIG. 22A with the obstruction of the pivoting of the latch hood when the sleeve has not been pushed forward.

DETAILED DESCRIPTION

Figure 1:
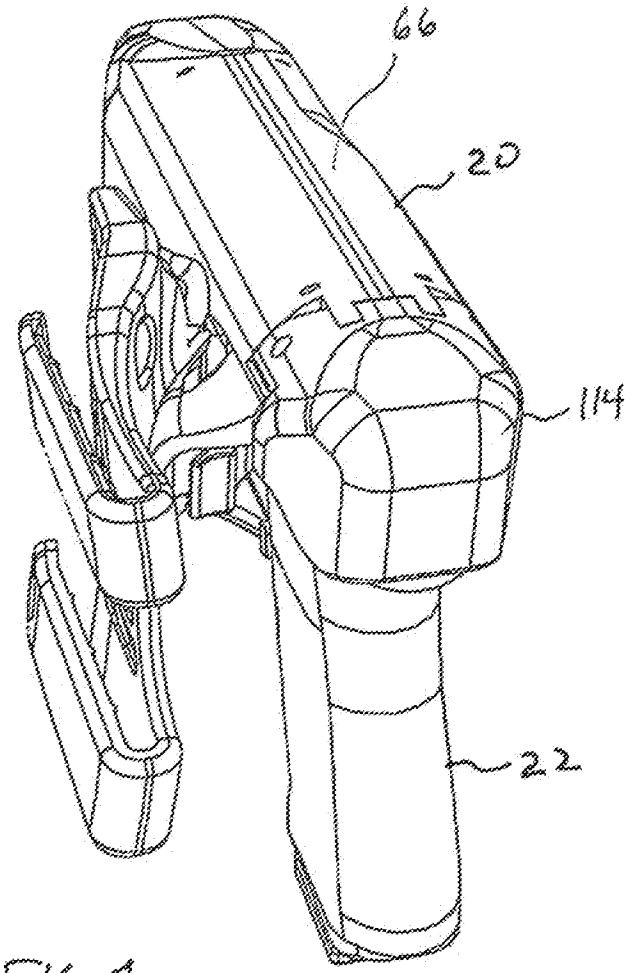
FIG. 1 is a top perspective view of a holster according to embodiments of the invention.
Figure 2:
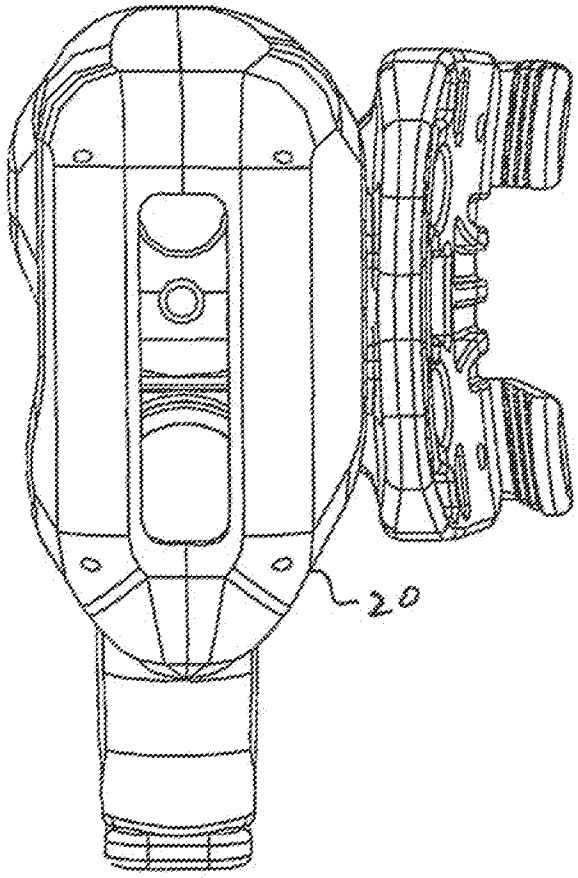
FIG. 2 is a bottom perspective view of the holster of FIG. 1.
Figure 3:
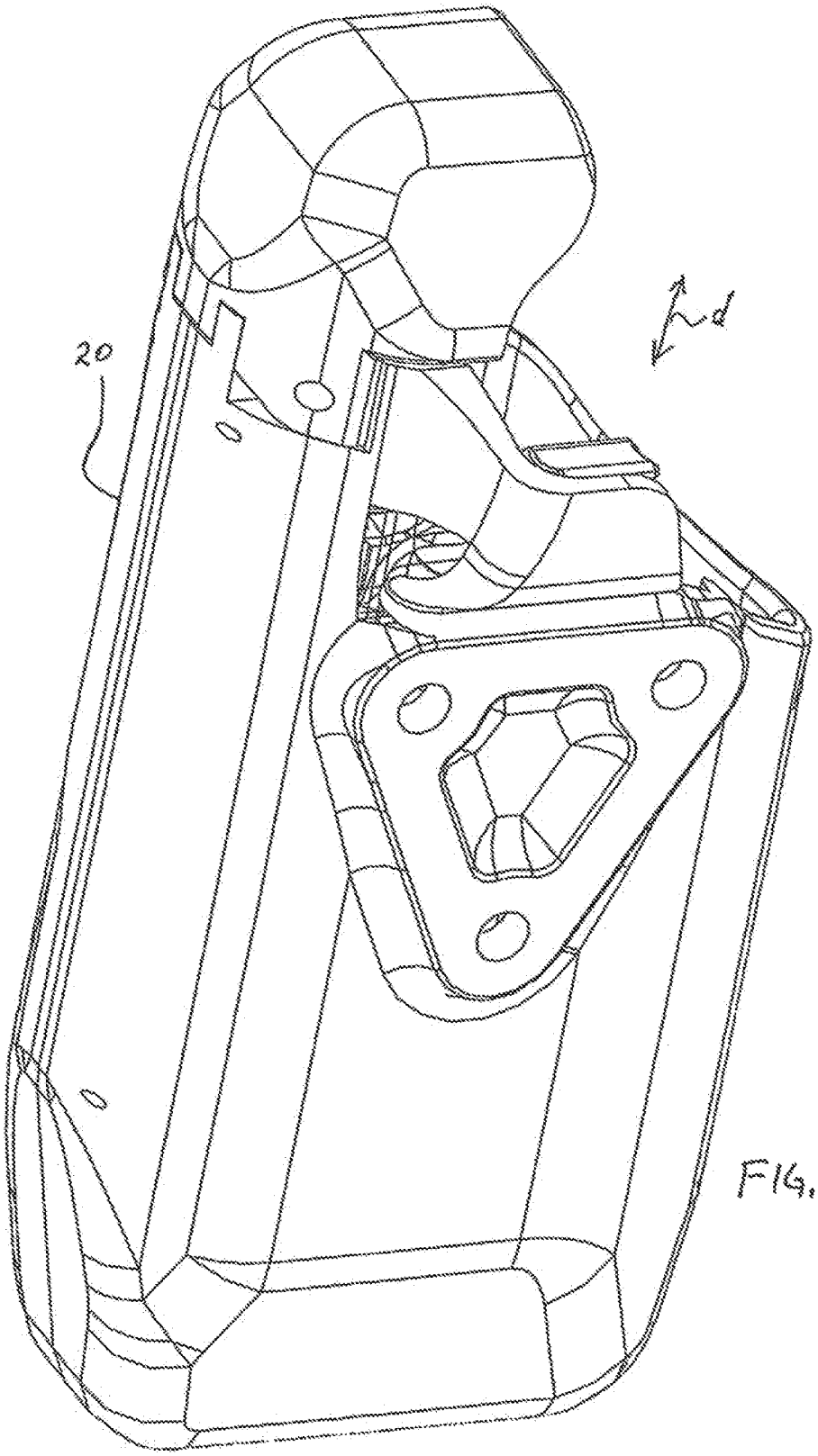
FIG. 3 is a side elevational view of the holster with the belt clip removed in accord with embodiments of the invention.

Referring to FIGS. 1-7, a holster 20 is configured to receive a handgun 22 and in particular embodiments is equipped with two retention means commonly actuated. The holster comprises generally a holster body 30, linkage configured as a slidably engaged internal retention sleeve 34 connected to the body, a handgun withdrawal obstructing member 40 configured as an ejection port obstruction member connected to the body, and a latch hood 46 connected to the body. A holster holding device such as an attachment clip 50 may be used to secure the holster to a belt or other harness. The handgun is a conventional semi-automatic with a slide 51 and ejection port 52 with a surface 55 that extends transverse to the direction d of insertion and removal of the firearm. The holster has a longitudinal axis a extending parallel to the insertion/withdrawal direction. Of note, the holster provides functionality even when the handgun has accessories such as laser illumination sights 53.

The holster body 30 or shell may be formed from two clam shell type halves 54, 56 that may be secured together by fasteners 58 or the body may be unitarily formed. The body has a bottom portion 60, sidewalls 62, 64, a forward wall portion 66, a rearward wall portion 68, and, an open top 70.

Referring to FIGS. 4, 7, 8, 9, 10 and 11, the U-shaped retention sleeve is shown in detail. The U-shaped sleeve is a motion transfer linkage to transfer the thumb downward motion to the opposite side of the holster where the ejection port of the slide is located. The sleeve has a top slide portion 76 which engages a cooperating groove 78 configured as a channel formed into the forward wall portion of the holster body. In other embodiments an axially extending groove may be provided in the slide to engage protruding portions extending from the body or shell. The sleeve has a forward spring catch 82 engaged with a spring 84 that is also engaged with the holster body, such as in a recess 85, to provide a bias to the sleeve towards the open top 70 of the holster. The sleeve further has a lever or pushbutton handle 86 integrally formed such as by injection molding with the slide portion 88 of the sleeve. The thumb button may be advantageously positioned between the firearm and a holster holding device, such as the clip illustrated. Latch hood engagement portions 90 provide recesses for cooperative engagement of the latch hood. The sleeve also has an engagement portion 94 configured as a surface defining a recess, an opening, an aperture or window for engaging the ejection port obstructing member 40 as the sleeve. Such a recess, an opening, an aperture or window provides a guide-in effect to minimize misalignments of the components and added reliability in the release function.

Figure 6:
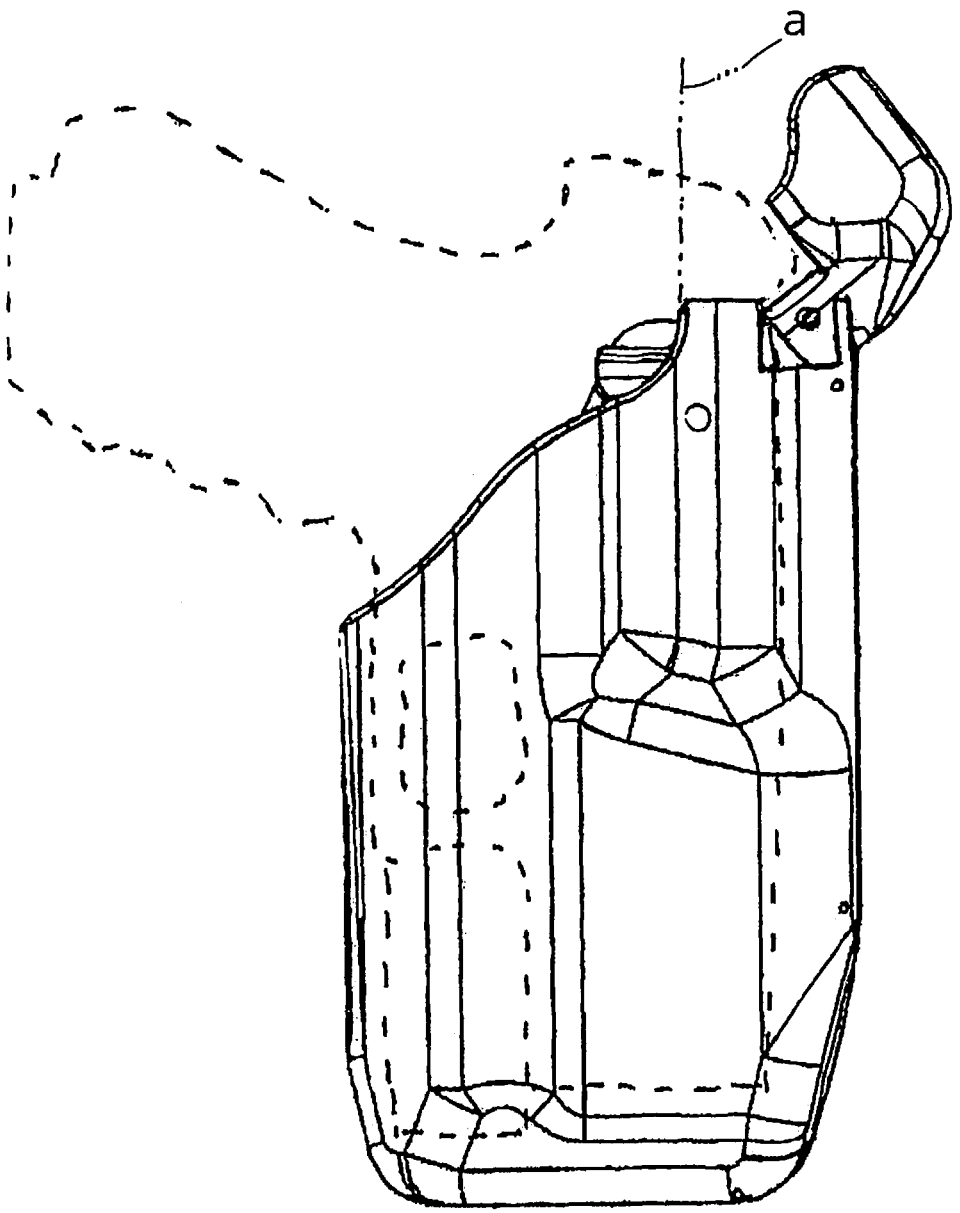
FIG. 6 is a view of the holster of FIG. 5 with the latch hood released for removal of the handgun in accord with embodiments of the invention.

The latch hood 46, or rear pivot guard, has sleeve engagement portions 102, 104 which cooperate and engage with the sleeve at the recesses 90 of the sleeve to prevent pivoting of the latch hood. The latch hood may be pivotally attached to the holster body by way of a pin 108 and may be biased towards an open unlatched position as illustrated in FIG. 6 by way of a torsion spring 112. The latch hood has a handgun slide obstructing cap portion 114 which when in a closed retention or capture position precludes removal of the handgun by obstructing the rear slide portion 115 of the handgun. The handgun is installed in the holster with the latch hood in the open release position as illustrated in FIG. 6.

Figure 4:
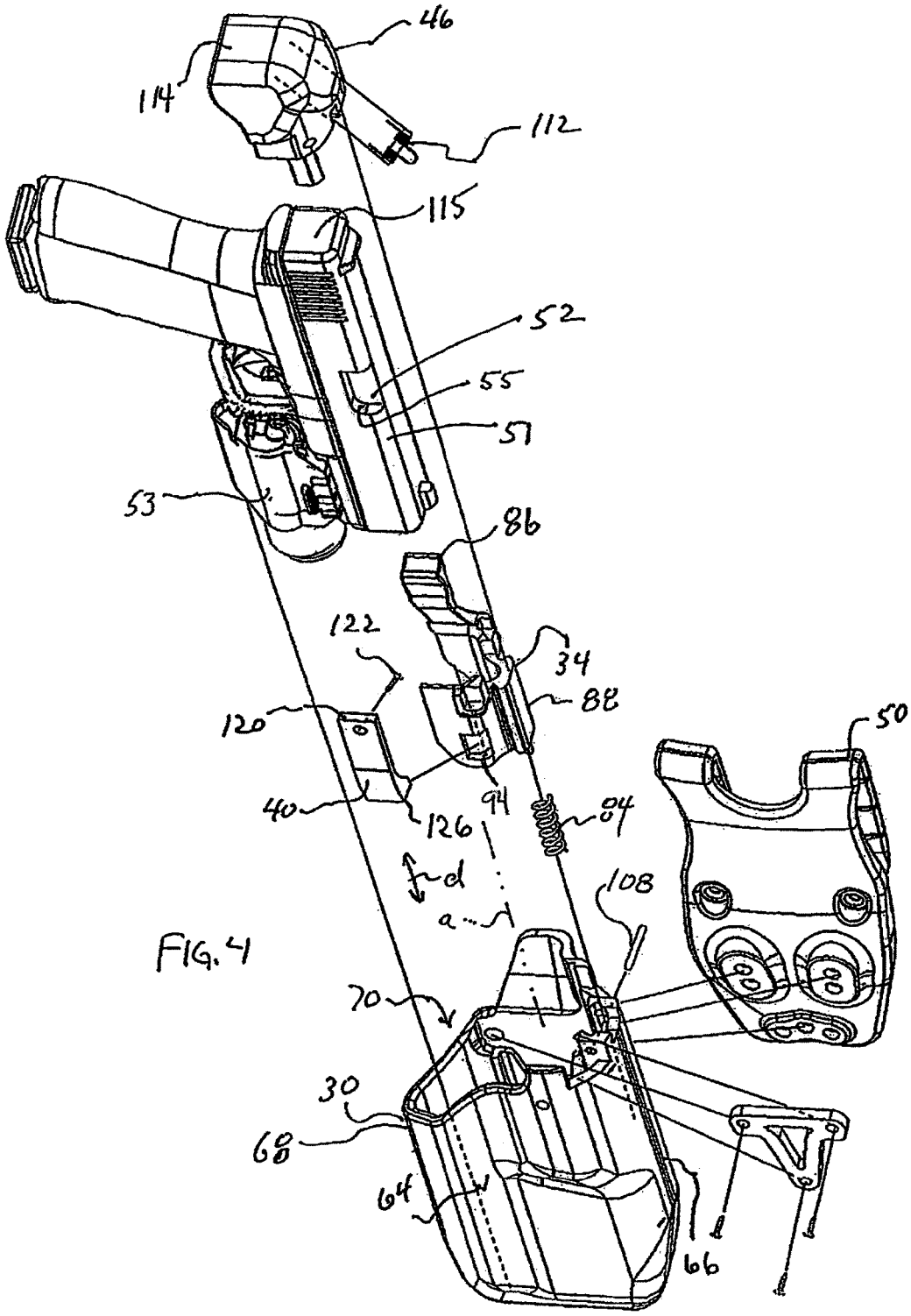
FIG. 4 is an exploded view of a holster and handgun in accordance with the invention.
Figure 5:
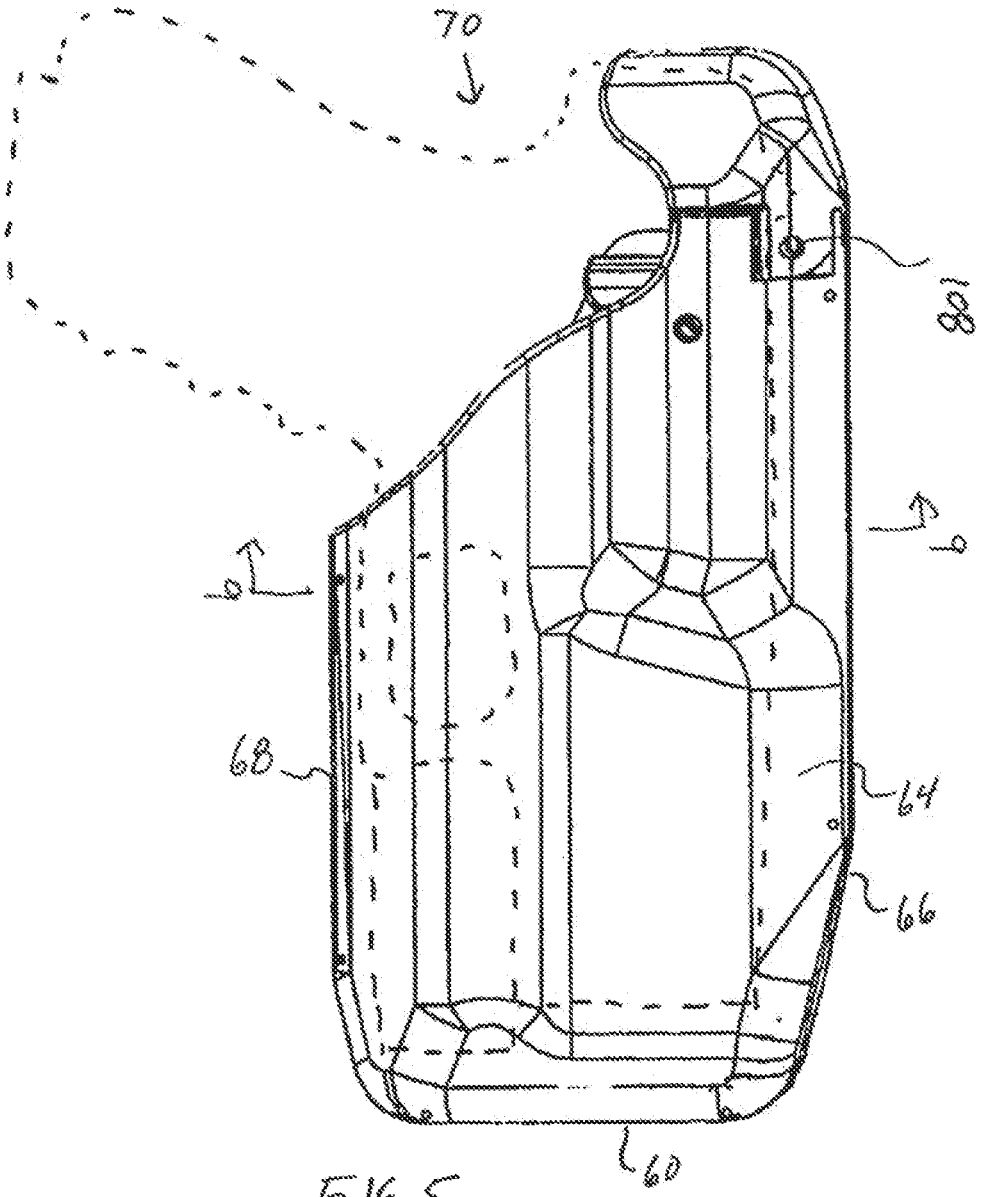
FIG. 5 is a side elevational view of a holster in accord with the invention with the handgun shown in phantom.
Figure 7:
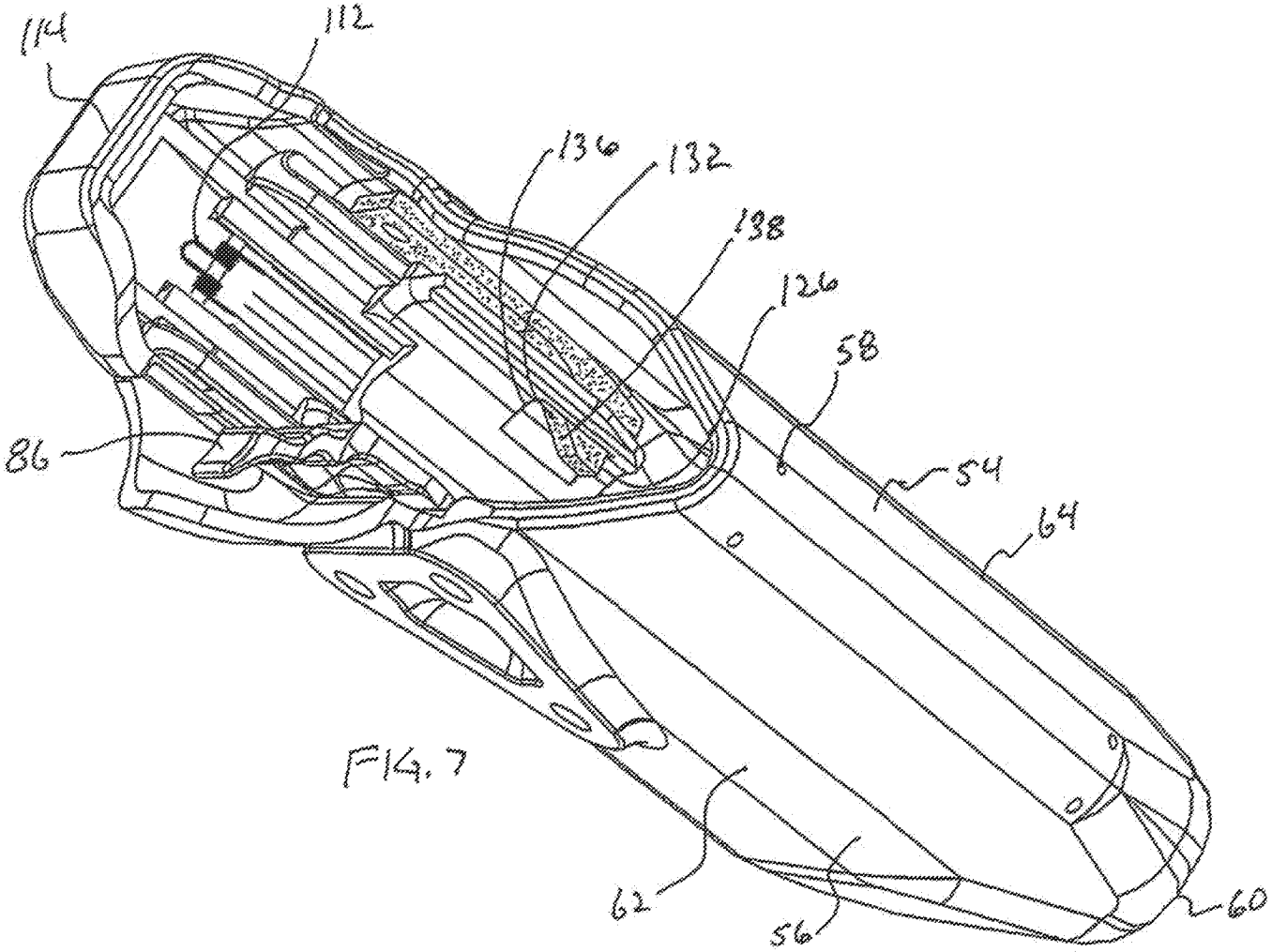
FIG. 7 is top perspective view showing the inside of the holster with the obstruction member shown stippled for purposes of clarity.
Figure 8:
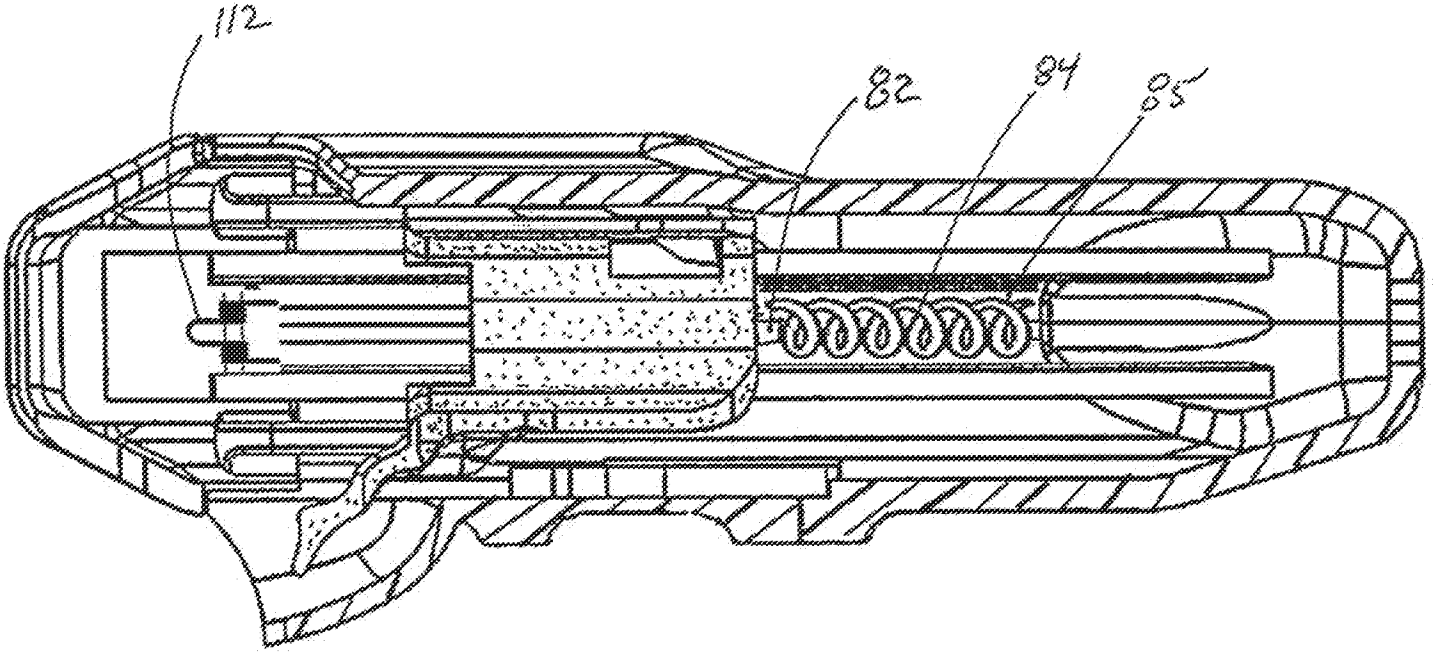
FIG. 8 is a cross-sectional view of the front of the holster with the retention sleeve shown stippled for clarity purposes.
Figure 9:
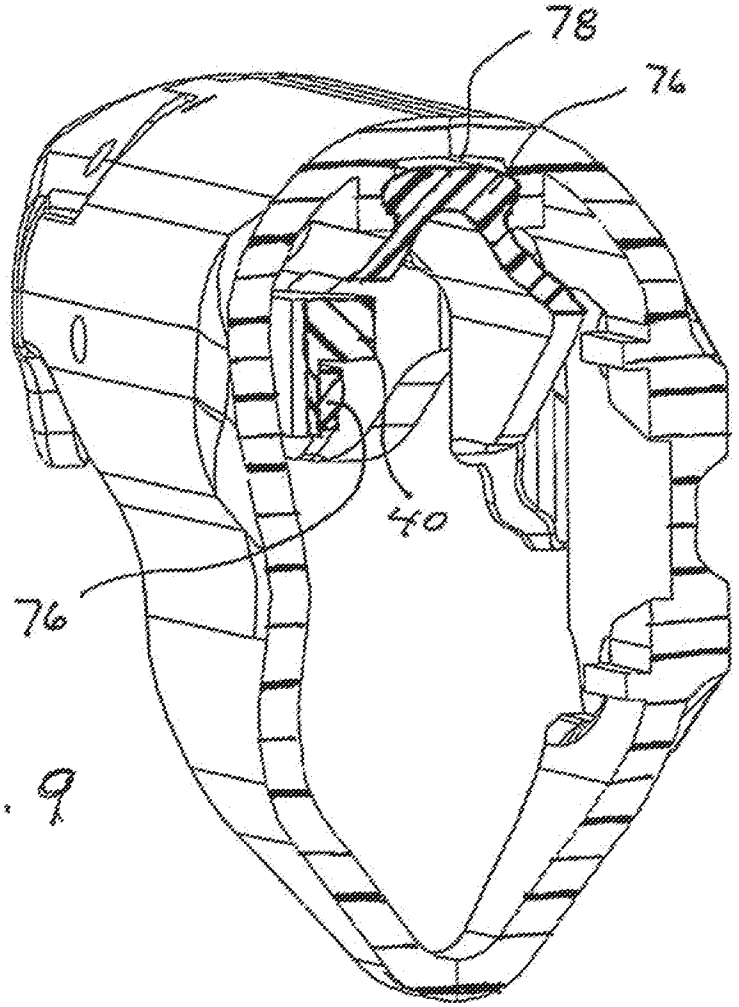
FIG. 9 is a cross-sectional view of the holster illustrating the sliding engagement of the sleeve with the holster body in accord with embodiments of the invention. The cross section taken at about line.

The ejection port obstruction member 40 is best illustrated in FIGS. 4, 7 and 9 and provides a capture or retention position and a release position by engaging a surface that extends transverse to the direction d of insertion and removal of the firearm. The surface may be an edge or edge surface of an ejection port of the slide. Alternative transverse surfaces may be utilized depending on the firearm and may also comprise a transverse surface on an accessory added to the firearm. The obstruction member 40 may be configured as a leaf spring with a first end 120 that is secured to the side wall 64 of the holster body by way of a fastener such as a screw 122, rivet, welding, or other means. The ejection port capture member may have a catch at the opposite second end 126. The capture member may be configured as a resilient leaf spring utilizing the resiliency of the leaf spring material to resiliently provide a normal position of retention by obstructing the ejection port of a handgun in the holster. The catch end 126 may have an angle that is best illustrated in FIG. 7 for enhanced securement at the ejection port. The catch member also has an engagement portion 132 that cooperates with the U shaped sleeve 34 at an engagement portion 136. The engagement provides that as the sleeve is depressed downwardly a cam follower or wedge surface 138 on the ejection port catch member is engaged by an engagement surface configured as a cam surface on the sleeve causing said ejection port capture member to move towards the side wall and away from the engagement position with the ejection port of the handgun. In other embodiments the obstruction member may be pivotally attached to the body with a retention position and a release position with the retention position blocking removal of the firearm by obstruction of a surface transverse to the insertion and removal directions of the firearm in the holster. The obstruction member may be biased by a spring to the obstructing position.

The holster holding device 50 may extend upwardly and provides restricted access to the thumb-release button. The holster may be disassembled such as by removal of the hood pin 108 and then sliding removal of the sleeve. Different sleeves may be utilized to convert the holster to conform to different firearms. In embodiments of the invention, a kit may be provided with a shell and differently configured sleeves to accommodate different handguns. Also, in embodiments, more than one obstructing member may be provided with such kits.

Figure 10:
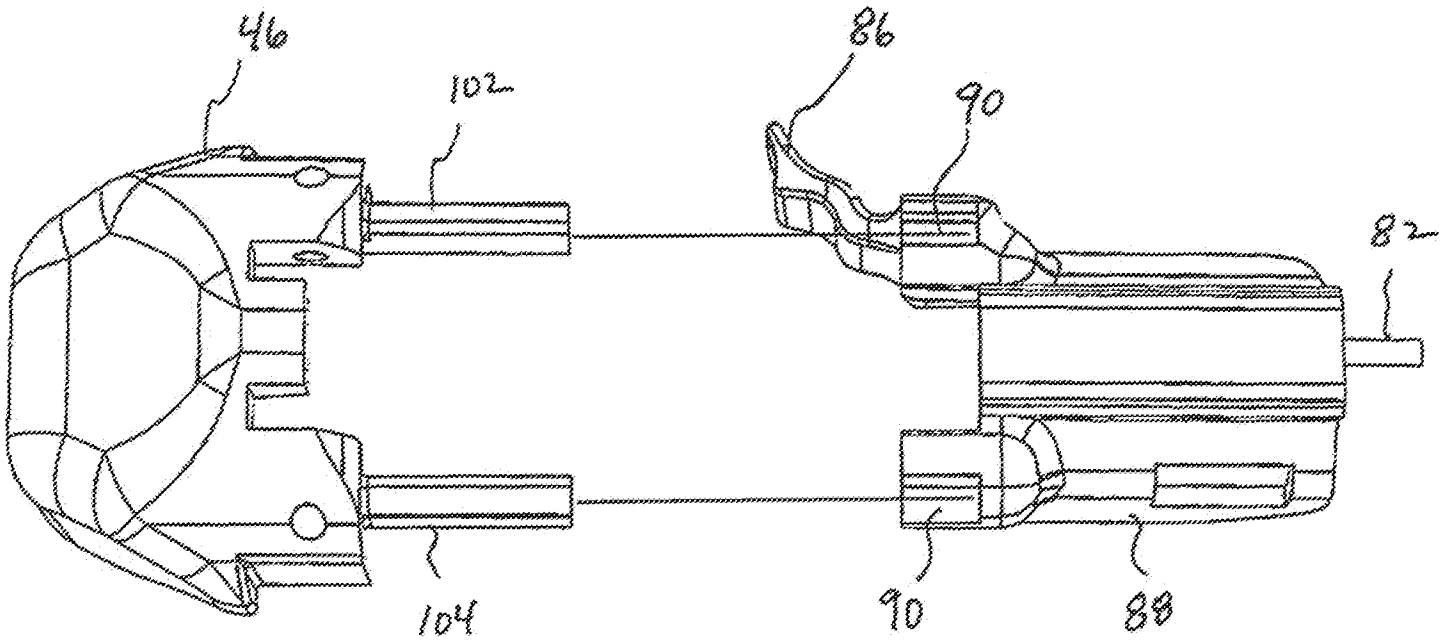
FIG. 10 illustrates the engagement mechanisms of the latch hood to the sleeve.
Figure 11:
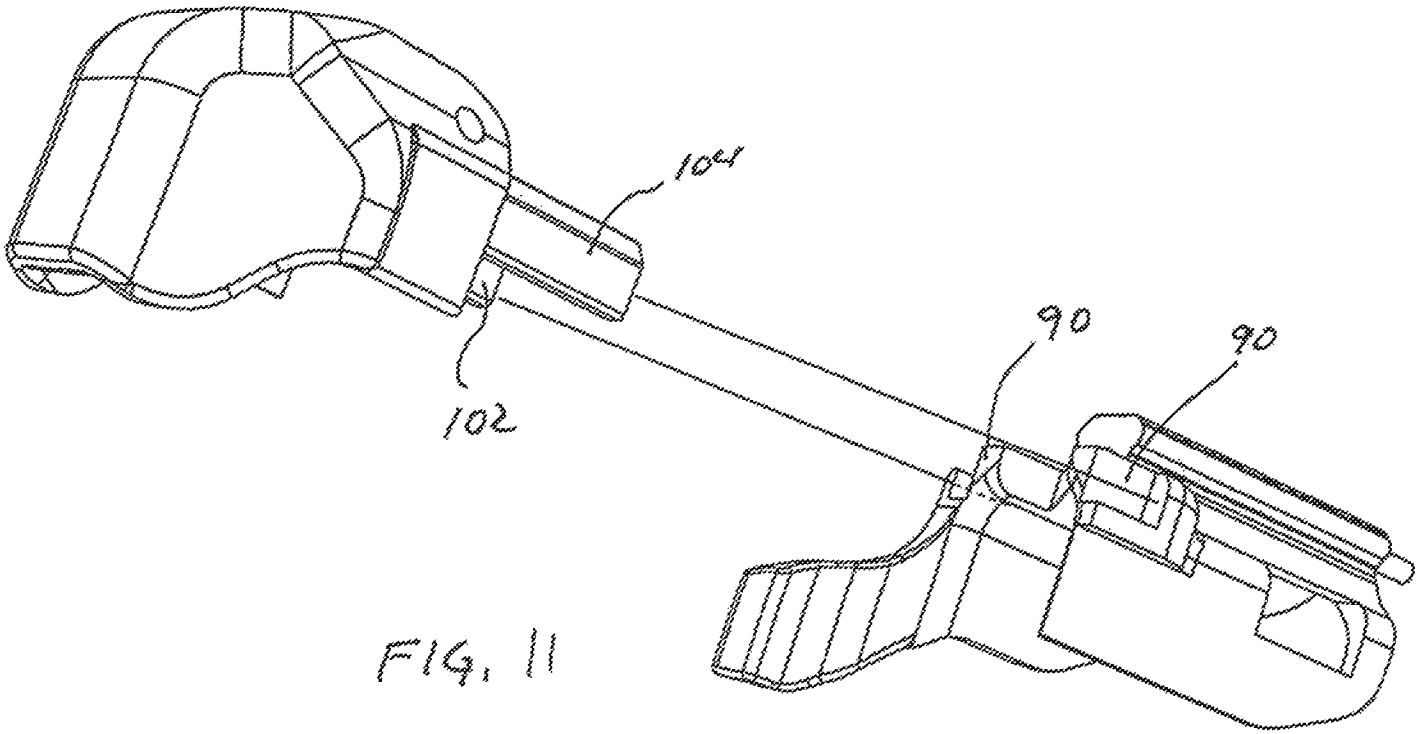
FIG. 11 is another view of the engagement of the latch sleeve to the hood.
Figure 12:
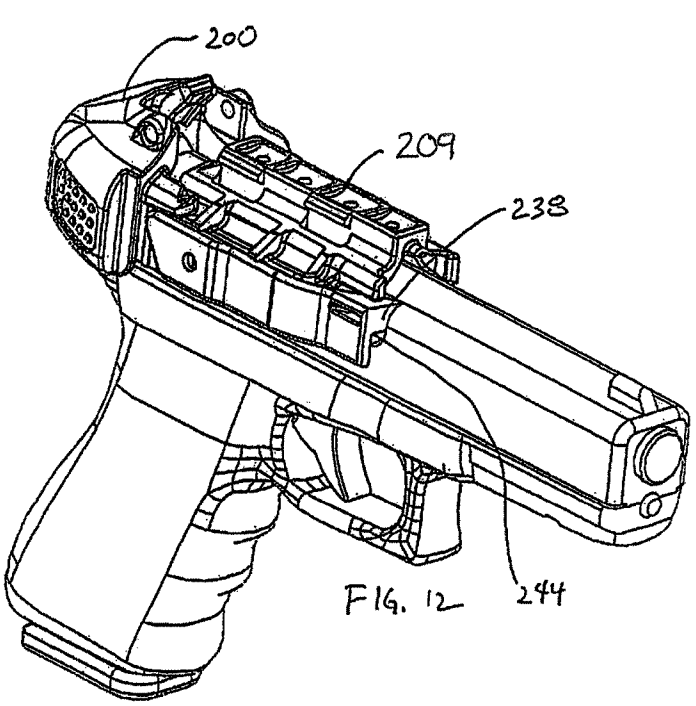
FIG. 12 is a perspective view of a handgun with two retention means and the actuation sleeve thereon without the shell illustrated for purposes of clarity.
Figure 13:
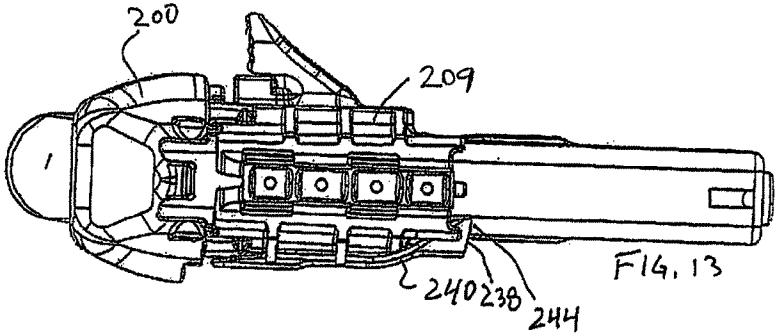
FIG. 13 is a view of the top of the gun (or the front of the holster) illustrating the retention means of FIG. 12.
Figure 15:
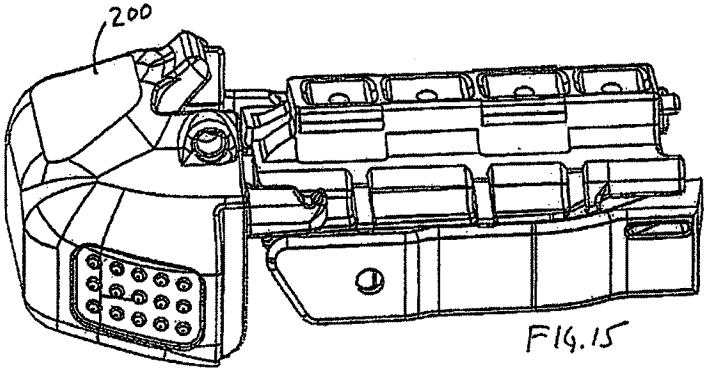
FIG. 15 is a perspective view of the retention means of FIGS. 12-14 without the handgun.
Figure 16:
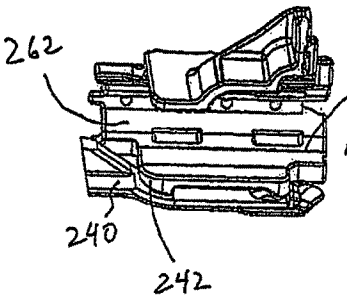
FIG. 16 is a perspective view of the sleeve and ejection port obstruction member as the cooperate in the holster.
Figure 17:
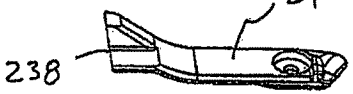
FIG. 17 is the same perspective view of FIG. 16 without the sleeve.

Referring to FIGS. 15-22F, a different embodiment of the holster retention mechanism is illustrated compared to FIGS. 10 and 11. The latch hood 200 has prongs 202, 204 are shorter than in the previous embodiment and have a notch 208 that precludes closure of the hood 200 without the downward (or forward) actuation of the sleeve 208. This assures the use of two retention mechanisms when the handgun is secured in the holster by way of precluding the latching of the pivot hood until the sleeve is forward which deflects the ejection port obstruction member. The sleeve has a top 210, sides 212, 214 and lower recess with a conforming shape to the handgun to be received. The sleeve engages the top surface of the handgun in the holster and has a T-shaped upper portion 220 that is received in the groove of the holster shell or body as illustrated best in FIG. 9. A thumb pushbutton 224 extends from a mid portion 226 of one of two side wall portions 212 which extend horizontal (when the axis of the gun and holster are horizontal) and taper downwardly.

Referring to FIGS. 22A to 22F, the sequence of operation of pivot hood retention mechanism is illustrated. FIG. 22*a* has the hood in the retention or obstruction position latched in place by the prongs resting on the platforms 234 of the sleeve 208. With the pushing of the pushbutton the result is illustrated in FIG. 22B and in FIG. 22C the sleeve no longer restricts the spring driven rotation of the hood and the hood is shown in a upward motion to the full open and release position of FIG. 22*d* and with the full downward position of the sleeve which then has the curved cam surface 242 of the sleeve fully deflecting outwardly the obstructing member 24 such that the stop surface 238 is in a non-obstructing position with respect to the handgun ejection port 244. FIG. 22*e* illustrates the sleeve sliding rearwardly (with respect to the handgun) or upwardly (with respect to the holster) and FIG. 22E illustrates the sleeve in its normal undepressed position and with the latch hood manually pivoted such that the grooves 208 are obstructed by the corners 252 of the platforms 234.

Figure 14:
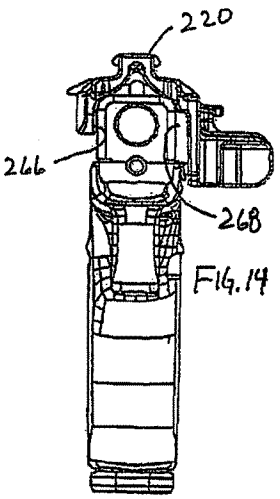
FIG. 14 is a view facing the front of the handgun an illustrating the relationship of the sleeve to the top surface of the handgun.
Figure 19:
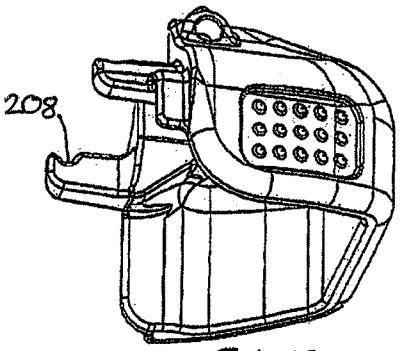
FIG. 19 is another perspective view of the latch hood of FIG. 18.
Figure 18:
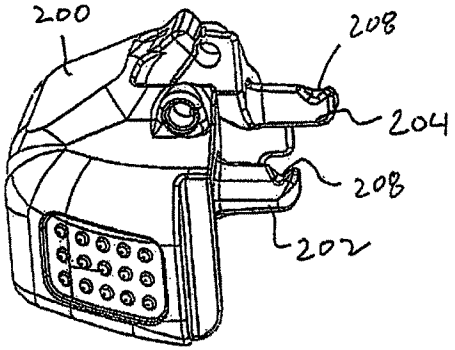
FIG. 18 is a perspective view of a different embodiment of a latch hood as compared to FIGS. 10 and 11.
Figure 21:
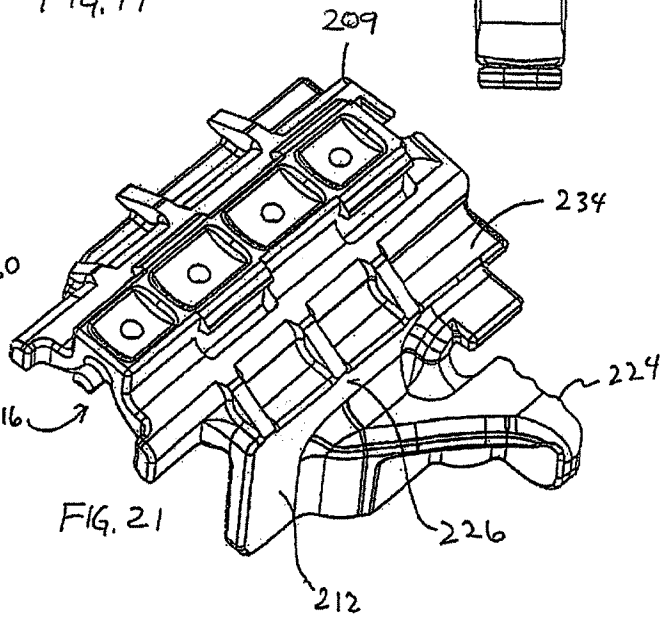
FIG. 21 is another perspective view of the actuation sleeve of FIG. 20.
Figure 20:
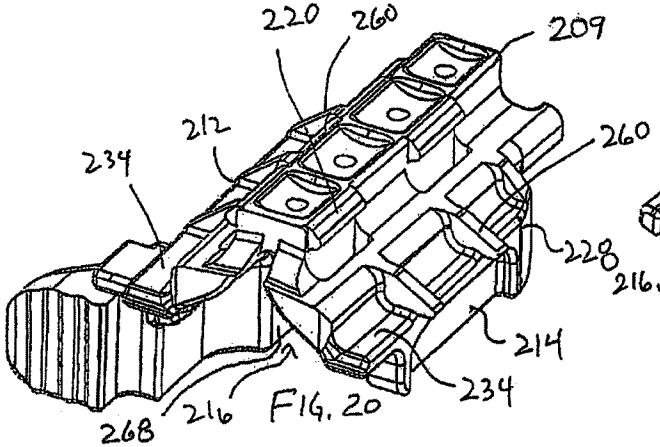
FIG. 20 is a perspective view of the actuation sleeve of FIGS. 12-16.

In addition to the T-shaped top portion 220, the sleeve may have bearing surfaces 260 on its sides to engage the inside surface of the holster body. The inside of the sleeve also has bearing surfaces 262 that engage the top surface of the handgun. Such bearing surfaces conform to the shape of the slide of the handgun. Also opposing side surfaces 266, 268 are parallel to each other and sandwich the slide of the handgun therebetween. As best illustrated by FIG. 14, the engagement of the handgun with the side surfaces may be a close fit with some tolerance to allow easy sliding of the handgun in and out of the holster without the slide gripping and impeding said insertion and withdrawal of the handgun.

The body and sleeve and ejection port obstructing member, and latch hood may be formed of injection molded polymers or composite construction. Generally the shell components, the sleeve, the obstructing member, and the latch hood will be rigid materials with some resilience. Nylons, polyethelenes, epoxies, may be suitable for example; such may be reinforced with glass, carbon or other fiber materials. Other materials may also be suitable, for example the ejection port obstructing member could readily be formed from spring steel or composite construction-polymer and steel.

The above references in all sections of this application are herein incorporated by references in their entirety for all purposes.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed:

1. A holster for a handgun having an ejection port, the holster comprising:

a holster body defining a cavity for receiving and holding the handgun the holster having an axis extending in a handgun insertion and withdrawal direction;

an axially movable member having a thumb push button, the axially movable member being slidably engaged with the holster body within the cavity of the holster body, the axially movable member having a first securement position and a second release position axially displaced forwardly from the first securement position;

an ejection port catch member attached to the holster body that engages with the handgun at the ejection port of the handgun, the catch member having a normal obstructing position with respect to the handgun ejection port, the catch member deflectable to a non obstructing position, the catch member engageable with the axially movable member utilizing a wedge surface such that moving the axially movable member from the first securement position to the second release position moves the catch member to the non obstructing position;

a latch guard pivotally coupled to the holster body, the latch guard having a closed capture position and an open release position, the latch guard in engagement with the axially movable member when the axially movable member is in the first securement position and when the latch guard is in the capture position, whereby when the axially movable member is moved from the first securement position to the second release position, the latch guard is released and moves to the open release position;

wherein the axially movable member has a U-shape with two opposing side surfaces for receiving a portion of the handgun therebetween.

2. The holster as set forth in claim 1, wherein the axially movable member includes a window and the ejection port catch member fits through the window of the axially movable member.

3. The holster as set forth in claim 1, wherein the thumb push button disengages the latch guard from the axially movable member and simultaneously or sequentially disengages the catch member from the ejection port of the handgun.

4. The holster as set forth in claim 1, wherein a portion of the catch member is attached to the holster body by a catch wedge spring, the catch wedge spring configured as a leaf spring to bias the catch member into the ejection port of the handgun.

5. The holster as set forth in claim 4, wherein the catch wedge spring compresses when the catch member disengages from the ejection port of the handgun.

6. The holster as set forth in claim 1, further comprising a holster holding device that attaches to the holster through a mounting plate, the mounting plate fitting inside the cavity of the holster.

7. The holster as set forth in claim 1, wherein the axially movable member further comprises an extruding component that engages with a spring.

8. The holster as set forth in claim 7, wherein the spring compresses when the thumb push button is pushed in a downward direction.

9. The holster as set forth in claim 1, wherein the axially movable member contains at least one prong for engaging with the latch guard, the latch guard having at least one internal compartment for receiving the at least one prong, the at least one prong having a largest dimension extending in the handgun insertion and withdrawal direction.

10. A method for securing a handgun into a holster, the holster comprising a holster body defining a cavity having an axis extending in a handgun insertion and withdrawal direction, the method comprising:

placing an axially movable member into the holster such that the axially movable member lines up with at least a portion of the defined cavity, the axially movable member having a U-shape with two opposing side surfaces for sandwiching a portion of the handgun therebetween;

compressing a spring that is located between the axially movable member and a ledge formed within the defined cavity of the holster;

engaging a catch wedge located inside the defined cavity of the holster with an ejection port of the handgun; and engaging a rear pivot guard with the axially movable member.

11. The method as set forth in claim 10, further comprising using a leaf spring to bias the catch wedge into the ejection port of the handgun and fitting the catch wedge through an aperture of the axially movable member.

12. The method as set forth in claim 10, further comprising engaging the rear pivot guard with the axially movable member by securely fitting at least one prong of the rear pivot guard into a slot of the axially movable member, the at least one prong having a largest dimension extending in the handgun insertion and withdrawal direction.

13. A holster for securing a handgun, the holster comprising:

a holster body defining a cavity for receiving and holding the handgun the holster having an axis extending in a handgun insertion and withdrawal direction;

an axially movable member coupled with a release lever, the axially movable member including a slot, the axially movable member having a U-shape with two opposing side surfaces for sandwiching a portion of the handgun therebetween;

a spring located between the axially movable member and the interior portion of the holster body;

a latch member that fits within the slot of the axially movable member and engages an ejection port of the handgun; and a latch guard that engages with the axially movable member.

14. The holster as set forth in claim 13, wherein a forward force applied to the release lever actuates the latch member to disengage from the ejection port of the handgun and simultaneously actuates the latch guard to disengage from the axially movable member, the axially movable member being slidably engaged with the holster body within the cavity of the holster body, the axially movable member having a first securement position and a second release position axially displaced forwardly from the first securement position.

15. The holster as set forth in claim 13, wherein the axially movable member contains a pair of slots for receiving a pair of prongs that are attached to the latch guard, each slot having a largest dimension extending in the handgun insertion and withdrawal direction.

16. The holster as set forth in claim 13, wherein:

the latch member includes a catch that engages the ejection port of the handgun;

a portion of the catch is attached to the holster body by a catch spring; and the catch spring is configured as a leaf spring to bias the catch into the ejection port of the handgun.

17. The holster as set forth in claim 13, wherein the latch guard is attached to the holster body by a pivot spring.

18. The holster as set forth in claim 13, wherein the latch guard is pivotably attached to the holster body, the latch guard covering a portion of the holster body when in a closed position.

19. The holster as set forth in claim 13, wherein the release lever decompresses the spring located between the axially movable member and the interior portion of the holster body.

* * * * *